US007120969B2

(12) United States Patent
Carls

(10) Patent No.: US 7,120,969 B2
(45) Date of Patent: Oct. 17, 2006

(54) BINDER CLIP

(76) Inventor: David R. Carls, 104 Paradise Harbor Blvd., #402, North Palm Beach, FL (US) 33408

( * ) Notice: Subject to any disclaimer, the term of this patent is extended or adjusted under 35 U.S.C. 154(b) by 109 days.

(21) Appl. No.: 11/014,369

(22) Filed: Dec. 16, 2004

(65) Prior Publication Data

US 2006/0130288 A1 Jun. 22, 2006

(51) Int. Cl.
*B42F 1/02* (2006.01)

(52) U.S. Cl. ..... 24/67.3; 24/67.5; 24/558; 24/565

(58) Field of Classification Search ..... 24/67.5, 24/558, 565, 67.3, 67.7, 67.9
See application file for complete search history.

(56) References Cited

U.S. PATENT DOCUMENTS

| | | | | |
|---|---|---|---|---|
| 467,244 | A | 1/1892 | Ballard | |
| 1,139,627 | A | 5/1915 | Baltzley | |
| 1,150,073 | A | 8/1915 | Spengler | |
| 1,435,917 | A | 11/1922 | Ensign | |
| 1,865,453 | A | 7/1932 | Baltzley | |
| 1,965,554 | A | 7/1934 | Mainwaring | 24/259 |
| 2,230,450 | A * | 2/1941 | Drane | 24/67.5 |
| 2,259,505 | A * | 10/1941 | Wisdom | 24/67.5 |
| 4,332,060 | A | 6/1982 | Sato | 24/67.9 |
| 4,532,680 | A | 8/1985 | Hashimoto | 24/67 |
| 4,696,081 | A | 9/1987 | Yen | 24/558 |
| 5,479,682 | A | 1/1996 | Hendrikx et al. | 24/67.11 |
| 5,533,236 | A | 7/1996 | Tseng | 24/67.5 |
| D372,498 | S | 8/1996 | Sato | D19/65 |
| 5,806,147 | A | 9/1998 | Sato | 24/67.9 |
| 5,896,624 | A | 4/1999 | Horswell | 24/67.5 |
| 5,946,778 | A | 9/1999 | McGarity | 24/536 |
| 5,950,283 | A | 9/1999 | Sato | 24/67 |
| 6,226,840 | B1 | 5/2001 | Lu | 24/67.5 |
| 6,374,463 | B1 | 4/2002 | Kaufman | 24/67.5 |
| D478,352 | S | 8/2003 | Huang | D19/65 |
| D485,870 | S | 1/2004 | Thomson | D11/78.1 |
| 2001/0032376 | A1 | 10/2001 | Payne | 24/67.5 |
| 2003/0115722 | A1 | 6/2003 | Shogbamimu et al. | 24/67 |
| 2004/0040122 | A1 | 3/2004 | Huang | 24/67.5 |

* cited by examiner

*Primary Examiner*—Robert J. Sandy
(74) *Attorney, Agent, or Firm*—Simpson & Simpson, PLLC

(57) ABSTRACT

A binder clip comprising a first side panel, second side panel and third side panel, integral with one another and arranged in the shape of a triangle, the first and third side panels having curled edge portions, and the first and third side panels spring-biased toward one another, a first and second lever made of wire and forming a loop, the first and second lever pivotally fixed to the first side panel and third side panel, respectively, the first and second levers arranged to pivot. The first and second levers are arranged to be retained or locked by linear protrusions emanating upwardly from the first and third side panels, respectively.

15 Claims, 7 Drawing Sheets

BINDER CLIP

FIELD OF THE INVENTION

The present invention relates generally to devices for clamping or binding papers, documents, materials, objects, and the like, and more particularly, to a binder clip comprising two pivotally fixed levers that may be restrained by upwardly emanating protrusions.

BACKGROUND OF THE INVENTION

Devices for fastening papers and like objects are well known in the art. There are many different types of paper fasteners including paper clips, staples and brads. Binder clips are also common devices used for keeping papers and the like bound.

For example, FIG. 1 is a perspective view of a prior art binder clip having a triangular cross-section and wire levers. This particular binder clip, shown in FIG. 1, is made by Acco World Corporation. The sidewalls of the clip are spring-biased towards a closed position. The sidewall edges each comprise circular bearings that engage the lever ends and allow the levers to be flipped up such that the clip may be opened, or to be flipped down into a closed position. However, as illustrated in FIG. 4, the upwardly flipped levers are bulky and make it difficult to stack documents one atop the other. The downwardly flipped levers as illustrated in FIG. 5 interfere with bound pages when the pages are flipped or turned, thereby making it difficult for one to read materials bound by the binder clip.

Others have attempted to overcome the problem of cumbersome binder clip levers. FIG. 2 is a top view of a binder clip disclosed in U.S. Pat. No. 1,965,554 (Mainwaring). Mainwaring attempts to solve the problem of the interfering levers by providing a binder clip having solid pivoting levers 1 wherein in a first position, the levers are perpendicular to the longitudinal axis of the clip body and in a second position, the levers are parallel to the longitudinal axis of the clip body. Solid pivoting levers 1 are each secured by a pivot pin comprising a rivet that passes through an upper washer, a keyhole slot in the lever, and then through the flat sidewall of the clip body. This invention suffers from the structural disadvantage of solid levers and a spring catch mechanism used to lock the levers in place. The spring catch mechanism is fixedly secured to the lever by the pivot pin and comprises a spring element having a pocket that engages a steel ball 2, which is forced by the upper washer to matingly engage pivoting lever apertures and apertures in the sidewalls, such as aperture 3. In addition, locking and unlocking the spring catch mechanism strains the pivoting joint causing it to weaken or wear out quickly.

Another patented pivoting lever binder clip is shown in FIG. 3, which illustrates a perspective view of a U-shaped spring binder clip having solid levers 5 attached by a pivoting joint 6 as disclosed in U.S. Pat. No. 467,244 (Ballard). Pivoting joint 6 allows the levers to be pivoted in a backward direction enabling the levers to then open the clip when squeezed, or in a forward direction enabling the bound object to be stored on a shelf without having levers 5 protruding outwardly. To lock each lever in a closed position, a protrusion from the clip's surface catches hole 8 in each lever. A first problem with this design is that it does not have curled edges that engage the lever ends. Therefore, a significant force will be transmitted through the pivoting joint when the levers are squeezed to open the clip causing excessive strain on the pivot. The pivot will further undergo strain when the inflexible solid lever is moved across the protrusion. Additionally, the protrusion from the clip body and the hole in the solid lever must align perfectly, requiring precision in manufacture of the clip.

What is needed, then, is an improved binder clip comprising pivoting levers made of wire and forming a loop, which can sustain significant force when squeezed and which lock into a preferred position by a structurally simple restraining mechanism, wherein protrusions emanating from the clip body wedge into parallel individual segments of the wire levers, thereby allowing one to pivot the levers to lay parallel to the length of the document being bound and out of the way of the reader.

BRIEF SUMMARY OF THE INVENTION

The present invention broadly comprises a binder clip comprising a first side panel, second side panel and third side panel, integral with one another and arranged in the shape of a triangle, the first and third side panels having curled edge portions, and the first and third side panels spring-biased toward one another, a first lever made of wire and forming a loop, the first lever pivotally fixed to the first side panel, the first lever arranged to pivot to a position where the loop engages the curled edge portion of the first side panel, a second lever made of wire and forming a loop, the second lever pivotally fixed to the third side panel, the second lever arranged to pivot to a position where the loop engages the curled edge portion of the third side panel, and a first linear protrusion emanating upwardly from the first side panel and arranged to wedge between parallel individual wire segments of the first lever to restrain the first lever in place, a second linear protrusion emanating upwardly from the third side panel and arranged to wedge between parallel individual wire segments of the second lever to restrain the second lever in place.

A general object of the invention is to provide a binder clip having levers that rotate 180 degrees into a position, wherein the pages of the document being bound may be flipped, turned and/or folded over more easily without one having to remove the binder clip.

Another object of the invention is to provide a binder clip having levers made of wire and forming a loop with parallel wire segments, wherein restraints are wedged between the parallel individual wire segments to hold the levers in different positions.

A further object of the invention is to provide a structurally durable binder clip having pivoting levers.

These and other objects, features, and advantages of the present invention will become readily apparent to those having ordinary skill in the art upon reading the following detailed description of the invention in view of the several drawings of the invention.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiment, it is understood that the invention is not limited to the disclosed embodiment.

Furthermore, it is understood that this invention is not limited to the particular methodology, materials, and modifications described and as such may, of course, vary. It is also understood that the terminology used herein is for the purpose of describing particular embodiments only, and is not intended to limit the scope of the present invention, which is limited only by the appended claims.

Although any methods, devices or materials similar or equivalent to those described herein can be used in the practice or testing of the invention, the preferred methods, devices, and materials are now described.

Figure 6:
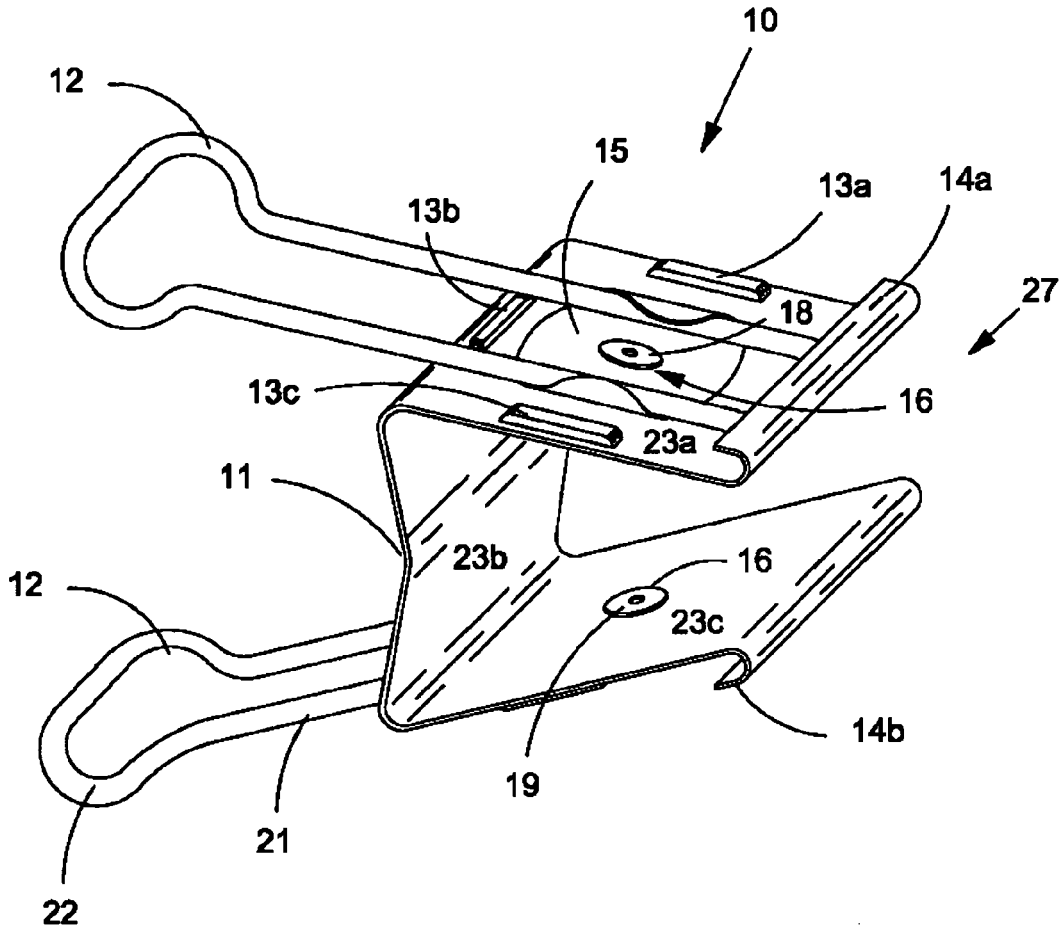
FIG. 6 is a perspective view of the present invention.

Averting now to the figures, FIG. 6 is a perspective view of the present invention illustrating the preferred embodiment of the binder clip 10. Binder clip 10 broadly comprises clip body 11 having a first side panel 23*a*, a second side panel 23*b*, and a third side panel 23*c*, integrally arranged and having a generally triangular cross-section. Binder clip 10 further comprises linear protrusions 13*a*, 13*b*, and 13*c* positioned on first side panel 23*a* and third side panel 23*c*, respectively, a first and second lever 12, and a first and second pivoting mechanism 16 on each of the first and third panels, respectively.

In the preferred embodiment, first side panel 23*a* and third side panel 23*c* are spring-biased toward one another such that the distal ends of first and third side panels 23*a* and 23*c*, respectively, form jaws 27. In a relaxed position, jaws 27 are closed such that distal ends of first side panel 23*a* and third side panel 23*c* are in contact with each other. Applying force to levers 12 (in a direction that forces the handles of the two levers toward one another) opens jaws 27. In the embodiment shown, clip body 11 is made of spring-steel. It is possible however, that other materials may be used, such as plastic, so long as the first side panel 23*a* and third side panel 23*c* are spring-biased toward one another. First side panel 23*a* and third side panel 23*c* further comprise curled edge portions 14*a* and 14*b*, respectively, distally disposed at jaws 27 of clip body 11. Curled edge portions 14*a* and 14*b* are described in more detail infra.

First and second levers 12 are pivotally fixed to first side panel 23*a* and third side panel 23*c*, respectively, via pivoting mechanism 16. Levers 12 are made of wire and form loops, each having a first loop 21 and a second loop 22. In the preferred embodiment, first loop 21 is in the shape of a "U" with parallel sides. Pivoting mechanism 16 comprises disk member 15 wherein pivoting mechanism and disk 15 are centrally positioned on clip body 11 and are described in more detail infra. Levers 12 are each held by disk 15 to the pivoting mechanism by curled edges on each disk 15 which hold wire segments of levers 12.

Figure 7:
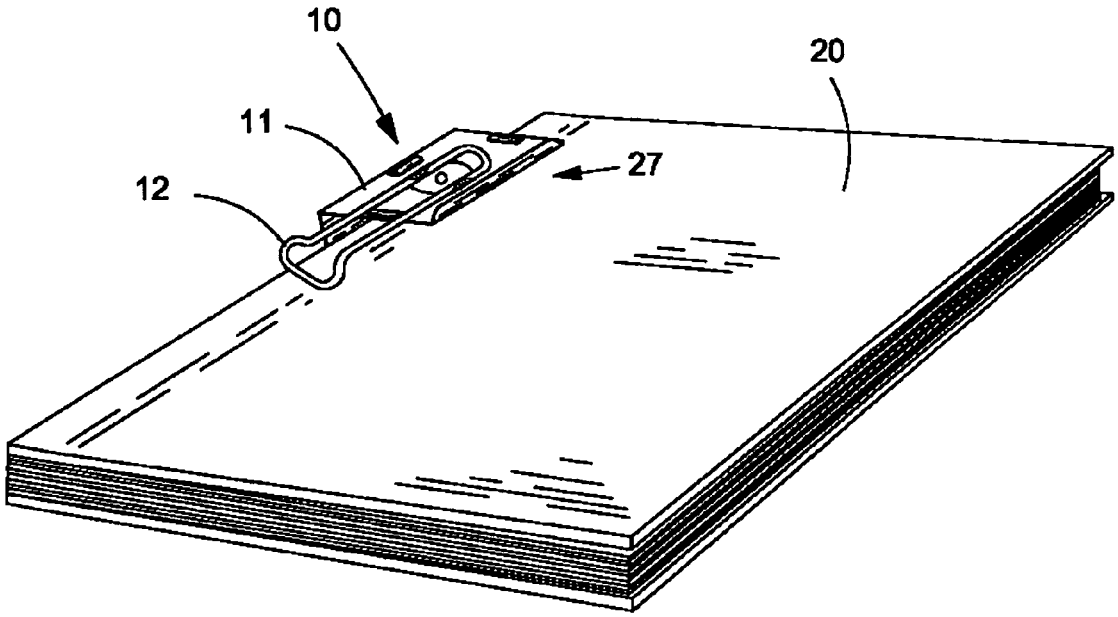
FIG. 7 is a perspective view of the present invention shown bound to a stack of papers.

FIG. 7 is a perspective view of the binder clip illustrating how the clip fastens a document, paper, or other materials together. Jaws 27 of clip body 11 are spring-biased toward one another and therefore, pinch object 20, inserted therebetween. Levers 12 have been rotated 90 degrees from the lever position shown in FIG. 6 such that the levers are parallel to the edge of object 20, and parallel to the longitudinal axis a-a of the binder clip (shown in FIGS. 8 and 9). Levers 12 in this position allow pages of the bound document to be folded over easily, thereby making it easier for one to read object 20 when bound by the clip.

Figure 1:
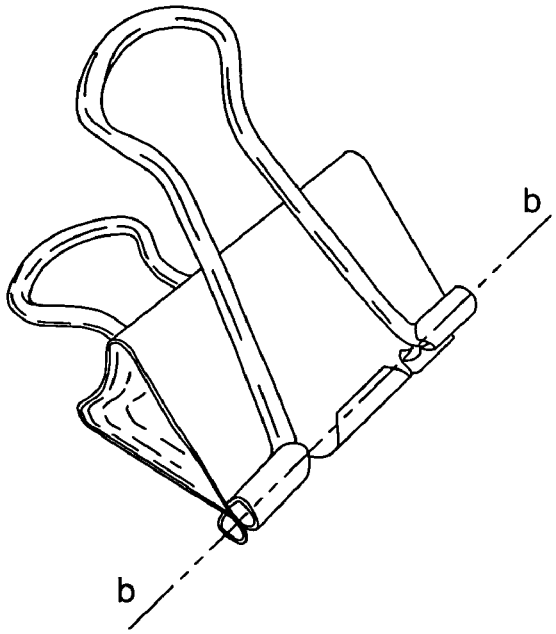
Prior Art Fig. 1
FIG. 1 is a perspective view of a conventional prior art binder clip.
Figure 2:
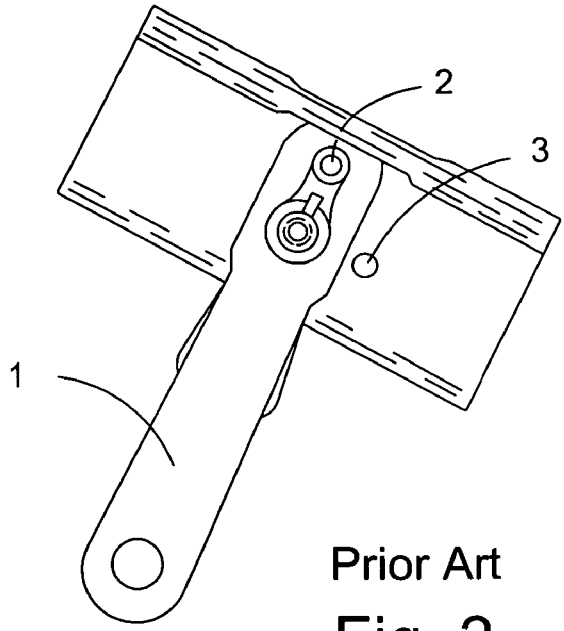
Prior Art Fig. 2
FIG. 2 is a top view of another prior art binder clip having solid pivoting levers.
Figure 3:
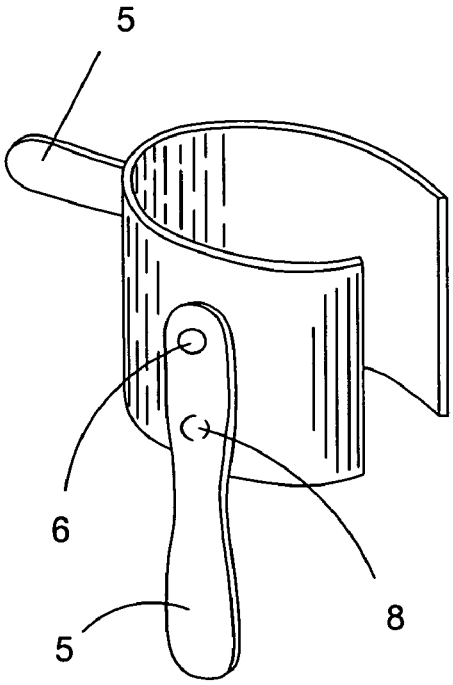
Prior Art Fig. 3
FIG. 3 is a perspective view of another prior art binder clip having a tubular clip body with pivoting levers.
Figure 4:
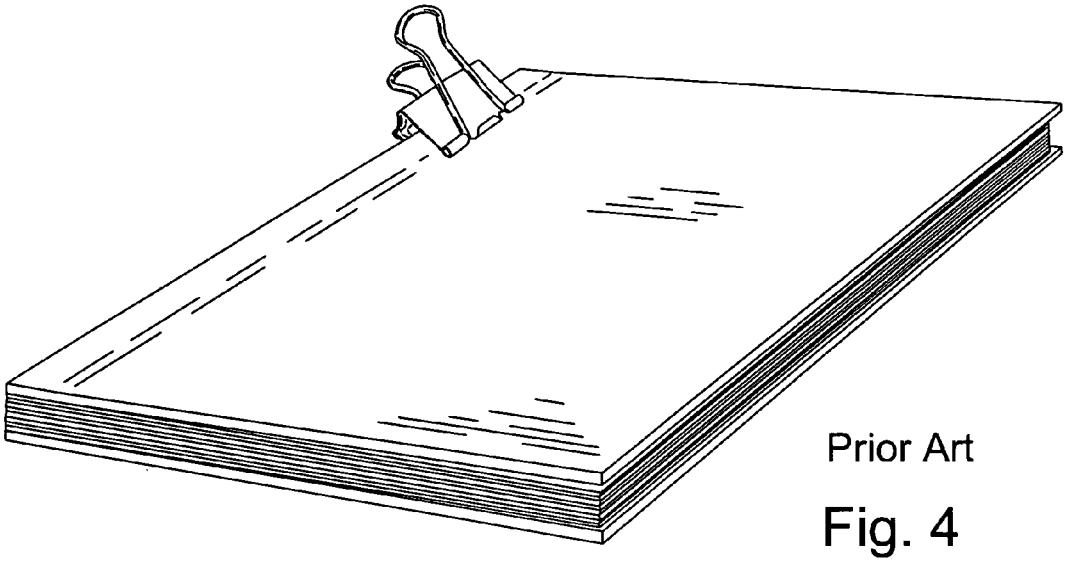
Prior Art Fig. 4
FIG. 4 is a perspective view of the conventional binder clip shown in FIG. 1, illustrating a document bound by the binder clip with its levers flipped in an upward position.
Figure 5:
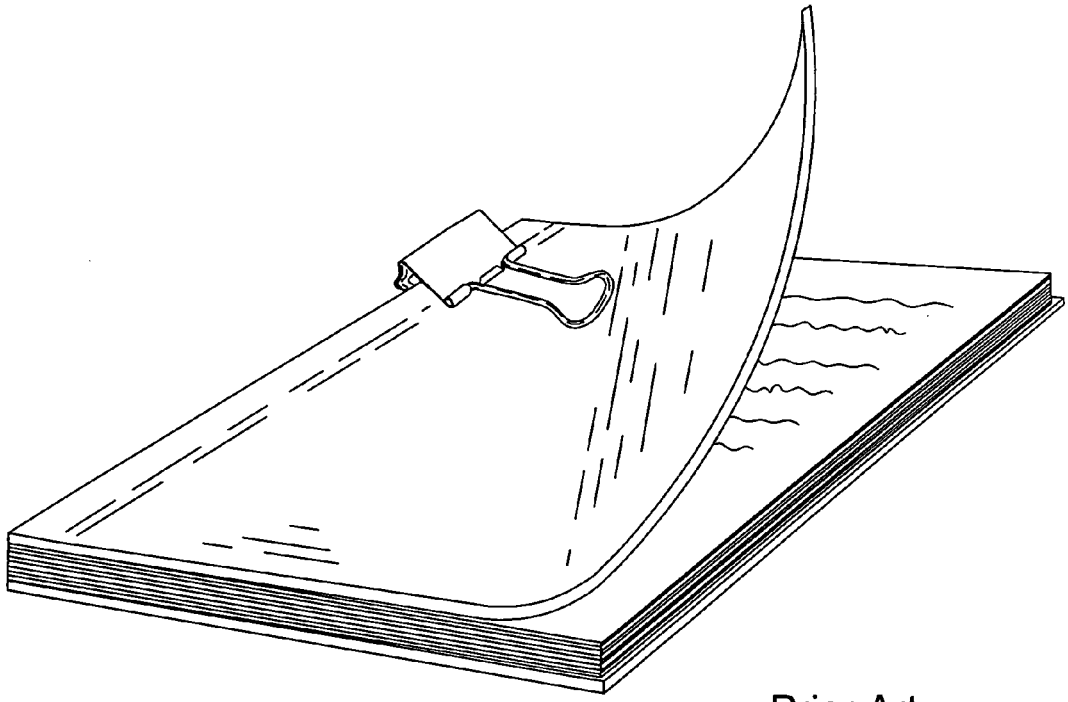
Prior Art Fig. 5
FIG. 5 is a perspective view of the conventional binder clip shown in FIGS. 1 and 4, but with the binder clip's levers flipped in a downward position.
Figure 8:
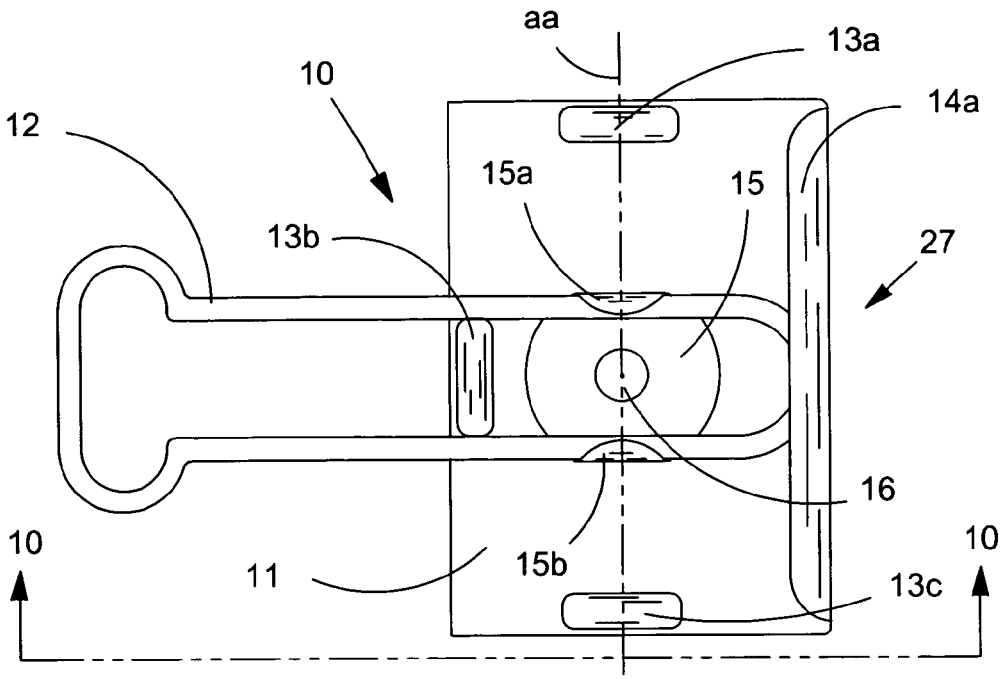
FIG. 8 is a top view of the binder clip shown in FIG. 6 illustrating the levers in a position perpendicular to the longitudinal axis of the binder clip body.
Figure 9:
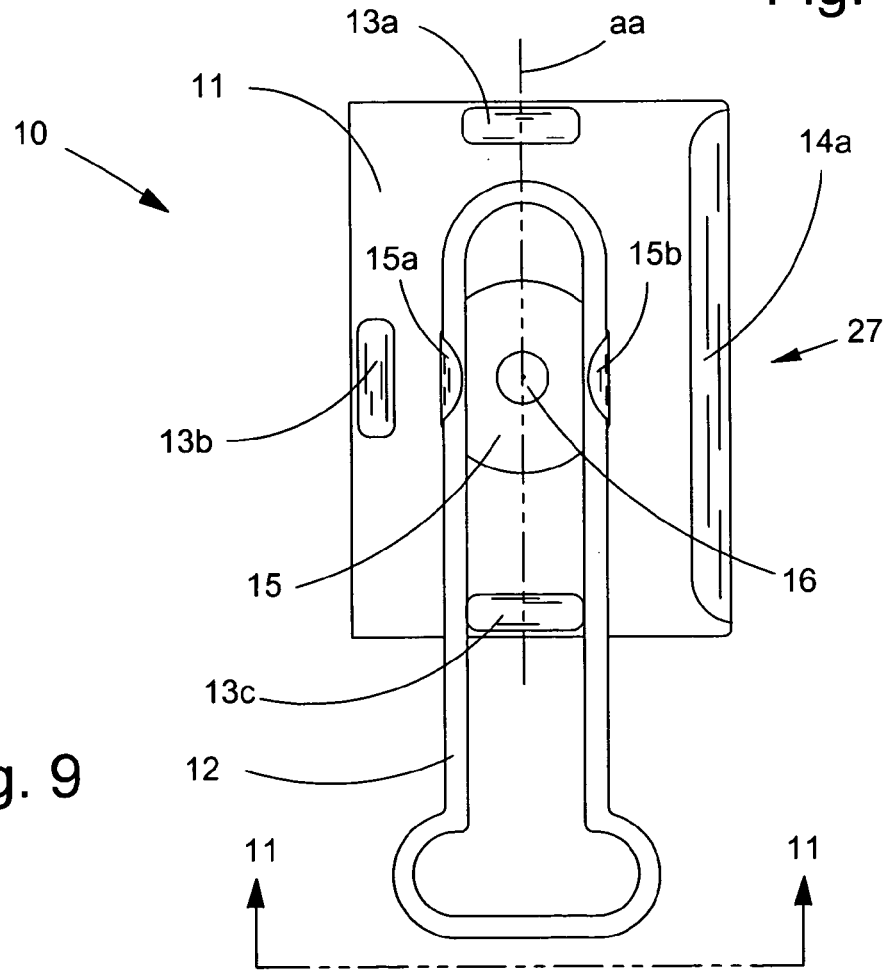
FIG. 9 is a top view of the binder clip shown in FIG. 6 illustrating the levers in a position parallel to the longitudinal axis of binder clip body.
Figure 10:
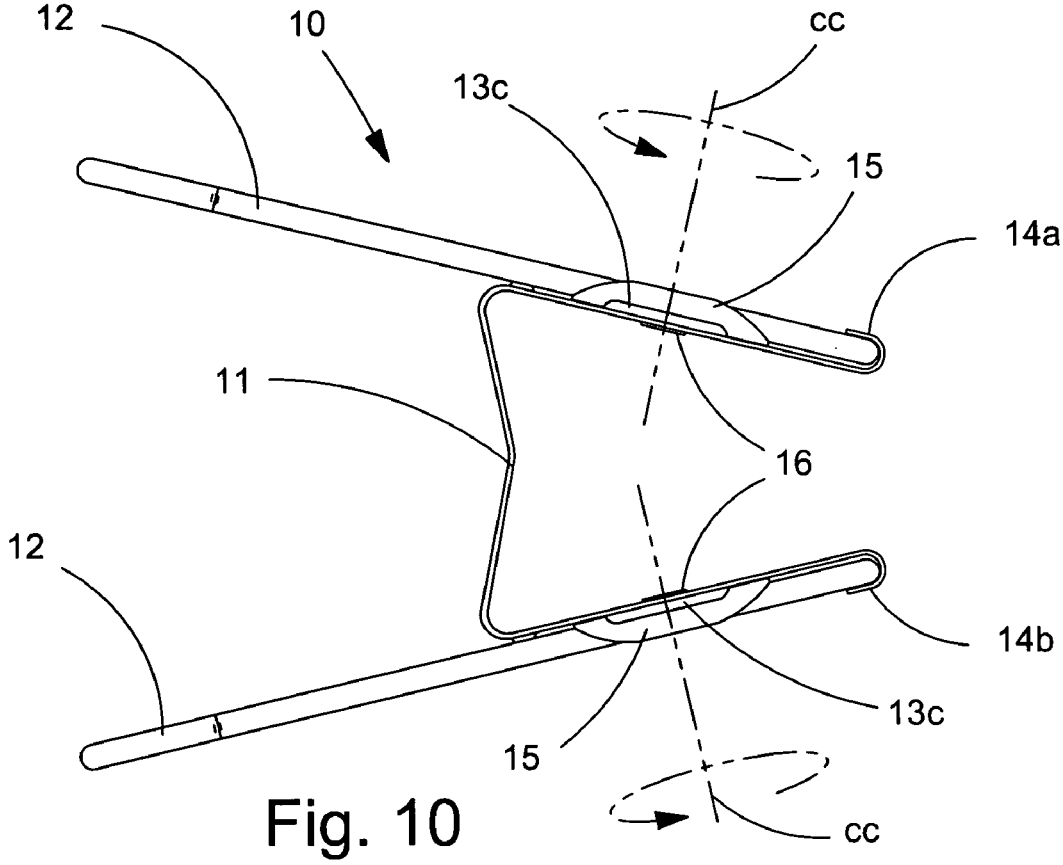
FIG. 10 is an end view of the binder clip taken generally along line 10—10 in FIG. 8.

FIGS. 8 and 9 are top views of the binder clip, illustrating lever 12 in a first opening position and a second reading position, respectively. In the opening position, lever 12 is positioned perpendicular to the longitudinal axis a-a of clip body 11 and also perpendicular to the edge of the papers bound by the binder clip. In this position, levers 12 may be squeezed toward one another, thereby causing jaws 27 of clip body 11 to open such that the clip may be clamped to an object. As shown in FIG. 9, lever 12 may be rotated 90 degrees from the opening position such that levers are in a reading position: parallel to the longitudinal axis a-a of clip body 11 and also parallel with the edge of the papers bound by the binder clip. In total, levers 12 are pivotally rotatable in an arc that slightly exceeds 180 degrees. As shown in FIG. 10, the levers pivot about an axis c-c that is arranged in space perpendicularly to the axis of rotation b-b of the prior art clip shown in FIG. 1.

FIGS. 8 and 9 further show linear protrusions 13*a*, 13*b*, and 13*c* that emanate upwardly from first and third side panels 23*a* and 23*c*, respectively. Protrusions 13*a*, 13*b*, and 13*c* are arranged to be wedged between parallel individual wire segments of first and second levers 12 to restrain levers 12 in place. In the preferred embodiment, protrusions 13*a*, 13*b*, and 13*c* are positioned parallel and proximate to each of the uncurled edges of the first and third side panels, 23*a* and 23*c*. It is also seen that protrusion 13*a* is arranged parallel to a first edge of first side panel 23*a*, protrusion 13*c* is arranged parallel to a second edge of first side panel 23*a*, and protrusion 13*b* is arranged perpendicularly with respect to protrusions 13*a* and 13*c*, respectively. The protrusions may be positioned at any distance from the edges of the clip body. In a preferred embodiment, a corresponding set of three protrusions emanate upwardly from the third side panel, similarly arranged. It should be appreciated, however, that the improved binding clip of the present invention would function adequately with only two protrusions (e.g., 13*a* and 13*b* and a similar pair emanating upwardly from the third side panel) arranged perpendicularly to one another, although this would limit the ability of the clip to lock the pivoting levers in 90 degree orientation rather than approximately 180 degree orientation.

Figure 11:
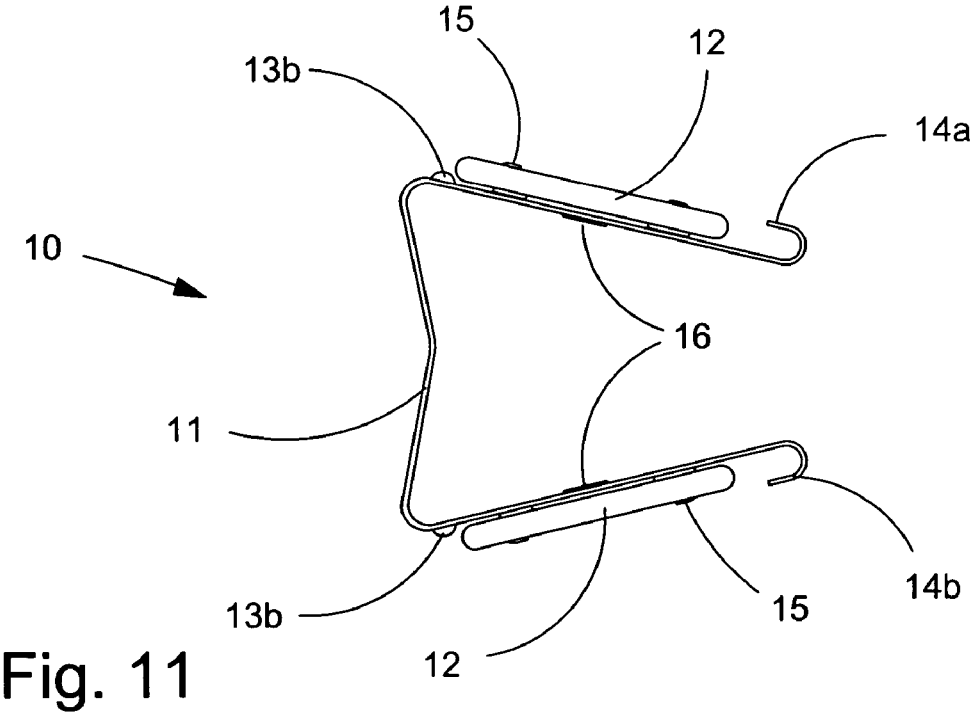
FIG. 11 is an end view of the binder clip taken generally along line 11—11 in FIG. 9; and, FIG. 12 is an exploded perspective view of the binder clip shown in FIG. 6.

FIGS. 10 and 11 are end views taken generally along lines 10—10 and 11—11, respectively, in FIGS. 8 and 9, respectively. Curled edges 14*a* and 14*b* form retaining channels that engage looped end portions of pivotally fixed levers 12 when levers 12 are perpendicularly positioned to the longitudinal axis of clip body 11, as shown in FIG. 10. Curled edges 14*a* and 14*b* absorb substantial force when levers 12 are squeezed to open the clip, preventing substantial force from being transmitted through the pivot mechanism. As shown in FIG. 11, when pivotally fixed levers 12 are parallel to the longitudinal axis of clip body 11, the distal ends of the levers do not engage the curled edges.

Figure 12:
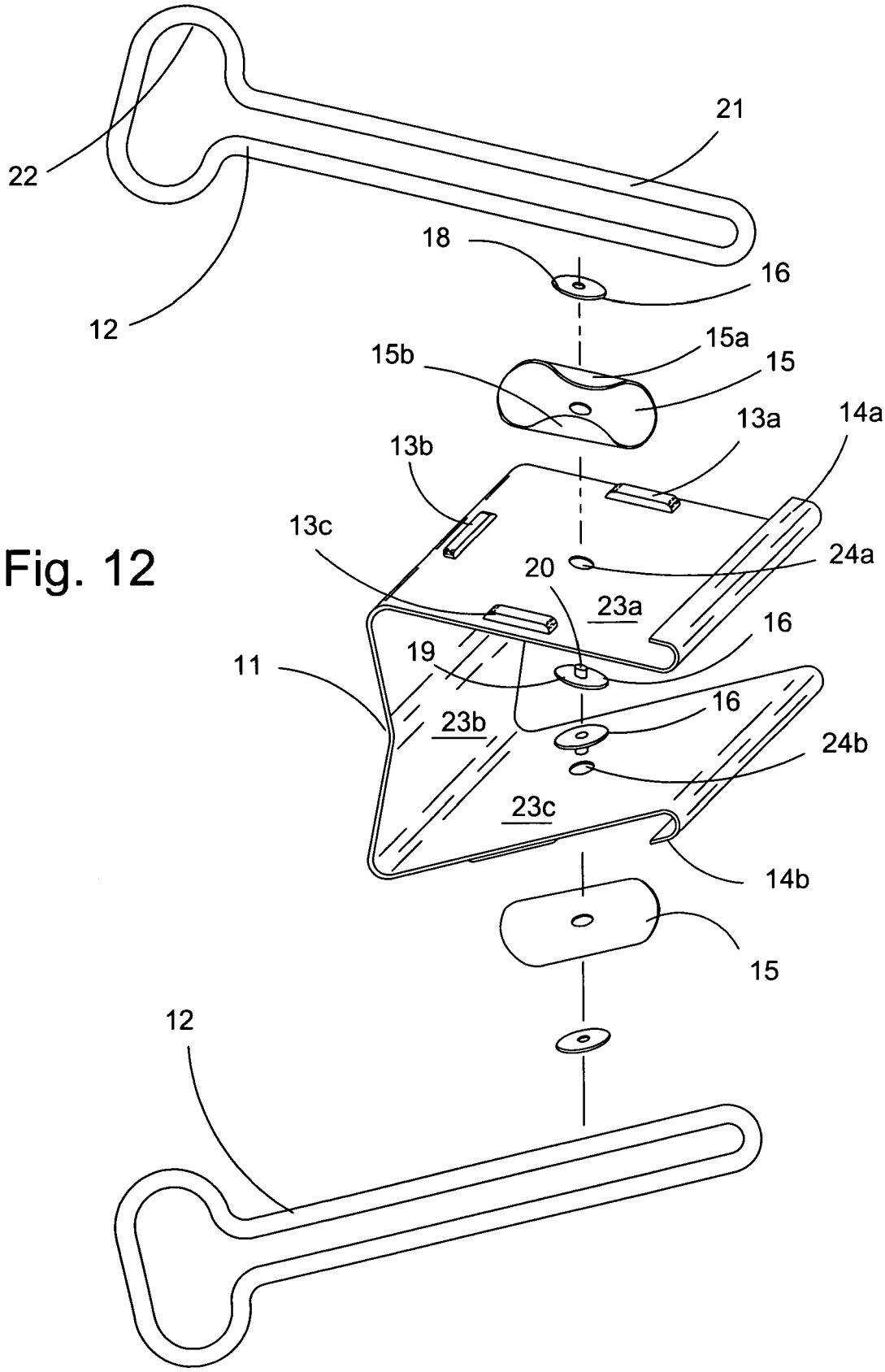

FIG. 12 is an exploded perspective view of binder clip 10 as shown in FIG. 6. Each of the first and second pivoting mechanisms 16 each comprise disk 15, upper washer 18, lower washer 19 and a shaft 20. Disk 15 is sandwiched between upper washer 18 and the outside of the first or third side panel 23*a* or 23*c*. Lower washers 19 are disposed on the underside of side panel 23*a* and side panel 23*c*. Shaft 20 passes through apertures in upper washer 18 and disk 15, then through centrally disposed aperture 24*a* or 24*b* in clip body 11, and finally through aperture in lower washer 19, thereby allowing the rotational motion of the pivoting mechanism. Mechanism 16 is thus a pivotable rivet. It should be appreciated by those having ordinary skill in the art that other types of pivoting mechanisms are contemplated and encompassed by the present disclosure and claims.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing form the spirit and scope of the present invention.

What I claim is:

1. A binder clip, comprising:

a first side panel, second side panel and third side panel, integral with one another and arranged in the shape of a triangle, said first and third side panels having curled edge portions, and said first and third side panels spring-biased toward one another;

a first lever made of wire and forming a loop, said first lever pivotally fixed to said first side panel, said first lever arranged to pivot to a position where said loop engages said curled edge portion of said first side panel;

a second lever made of wire and forming a loop, said second lever pivotally fixed to said third side panel; said second lever arranged to pivot to a position where said loop engages said curled edge portion of said third side panel; and a first linear protrusion emanating upwardly from said first side panel and arranged to wedge between parallel individual wire segments of said first lever to restrain said first lever in place;

a second linear protrusion emanating upwardly from said first side panel and arranged to wedge between parallel individual wire segments of said first lever to restrain said first lever in place.

2. The binder clip recited in claim 1 wherein said first and second levers comprise a first open wire loop having said parallel individual wire segments.

3. The binder clip recited in claim 1 wherein said first and third side panels each have a pivoting mechanism positioned on said first and third side panels.

4. The binder clip recited in claim 3 wherein said first and second levers are fixedly secured to each of said pivoting mechanisms.

5. The binder clip recited in claim 3 wherein said pivoting mechanism is selected from the group consisting of pivot, hinge, rivet, and screw.

6. The binder clip as recited in claim 1 wherein said first and second levers are operatively arranged to rotate approximately 180 degrees to allow said first and second levers to be positioned approximately parallel to a longitudinal axis of said first and third side panels, respectively, of said binder clip.

7. The binder clip as recited in claim 1 further comprising a third linear protrusion emanating upwardly from said first side panel and arranged to wedge between parallel individual wire segments of said first lever to restrain said first lever in place.

8. The binder clip as recited in claim 7 wherein said third linear protrusion is arranged parallel to said first linear protrusion and is located proximate a second edge of said first side panel.

9. The binder clip as recited in claim 1 wherein said first linear protrusion emanating upwardly from said first side panel is positioned parallel and proximate to a first edge of said first side panel.

10. The binder clip as recited in claim 9 wherein said second linear protrusion emanating upwardly from said first side panel is positioned perpendicularly with respect to said first linear protrusion.

11. The binder clip of claim 1 further comprising:

a fourth linear protrusion emanating upwardly from said third side panel and arranged to wedge between parallel individual wire segments of said second lever to restrain said second lever in place;

a fifth linear protrusion emanating upwardly from said third side panel and arranged to wedge between parallel individual wire segments of said second lever to restrain said second lever in place.

12. The binder clip as recited in claim 11 further comprising a sixth linear protrusion emanating upwardly from said third side panel and arranged to wedge between parallel individual wire segments of said second lever to restrain said second lever in place.

13. The binder clip as recited in claim 12 wherein said sixth linear protrusion is arranged parallel to said fourth linear protrusion and is located proximate a second edge of said third side panel.

14. The binder clip as recited in claim 11 wherein said fifth linear protrusion emanating upwardly from said third side panel is positioned perpendicularly with respect to said fourth linear protrusion.

15. The binder clip as recited in claim 11 wherein said fourth linear protrusion emanating upwardly from said third side panel is positioned parallel and proximate to a first edge of said third side panel.

* * * * *